US008744613B2

(12) United States Patent
Saito

(10) Patent No.: US 8,744,613 B2
(45) Date of Patent: Jun. 3, 2014

(54) SHEET PROCESSING APPARATUS, METHOD OF CONTROLLING THE SAME, AND STORAGE MEDIUM STORING PROGRAM

(75) Inventor: Sho Saito, Kawasaki (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/468,396

(22) Filed: May 10, 2012

(65) Prior Publication Data

US 2012/0290123 A1 Nov. 15, 2012

(30) Foreign Application Priority Data

May 11, 2011 (JP) ..... 2011-106630

(51) Int. Cl.
*G06F 7/00* (2006.01)

(52) U.S. Cl.
USPC ..... 700/217; 700/219; 700/222; 700/218

(58) Field of Classification Search
None
See application file for complete search history.

(56) References Cited

U.S. PATENT DOCUMENTS

2010/0161112 A1* 6/2010 Kurakata ..... 700/217

FOREIGN PATENT DOCUMENTS

JP 2010143718 A 7/2010

* cited by examiner

*Primary Examiner* — Yolanda Cumbess
(74) *Attorney, Agent, or Firm* — Rossi, Kimms & McDowell LLP

(57) ABSTRACT

In a sheet processing apparatus which is able to control to stack a sheet on at least one of a plurality of stacking units which stack printed sheets, when a first sheet having a small size is stacked on a first stacking unit, and a second sheet having the small size is designated to be stacked on a second stacking unit different from the first stacking unit, it is determined whether a sheet is stacked on a stacking unit adjacent to the second stacking unit, and a third stacking unit, that is different from the second stacking unit and is adjacent to a stacking unit on which a sheet is stacked, is selected as a stacking unit for the second sheet if it is determined that no sheet is stacked on the stacking unit adjacent to the second stacking unit.

8 Claims, 13 Drawing Sheets

FIG. 11A

| | PRESENCE/ ABSENCE OF SHEETS | SIZE OF STACKED SHEETS |
|---|---|---|
| STACKER TRAY 605 | ABSENCE | — |
| STACKER TRAY 606 | ABSENCE | — |

FIG. 11B

| | PRESENCE/ ABSENCE OF SHEETS | SIZE OF STACKED SHEETS |
|---|---|---|
| STACKER TRAY 605 | PRESENCE | A4 |
| STACKER TRAY 606 | ABSENCE | — |

FIG. 11C

| | PRESENCE/ ABSENCE OF SHEETS | SIZE OF STACKED SHEETS |
|---|---|---|
| STACKER TRAY 605 | PRESENCE | A4 |
| STACKER TRAY 606 | PRESENCE | B5 |

FIG. 11D

| | PRESENCE/ ABSENCE OF SHEETS | SIZE OF STACKED SHEETS |
|---|---|---|
| STACKER TRAY 605 | PRESENCE | A3 |
| STACKER TRAY 606 | PRESENCE | A3 |

FIG. 12

| | |
|---|---|
| SMALL SIZE | A4,B5 |
| LARGE SIZE | A3,B4 |

SHEET PROCESSING APPARATUS, METHOD OF CONTROLLING THE SAME, AND STORAGE MEDIUM STORING PROGRAM

BACKGROUND OF THE INVENTION

1. Field of the Invention

The present invention relates to a sheet processing apparatus, a method of controlling the same, and a storage medium storing a program.

2. Description of the Related Art

A conventional sheet processing apparatus includes a plurality of stacking units such as stacking trays in a stacker apparatus which stacks sheets, and stacks sheets on each stacking unit (Japanese Patent Laid-Open No. 2010-143718).

In the technique described in Japanese Patent Laid-Open No. 2010-143718, small sheets such as A4 sheets are delivered and stacked on one stacking tray, while large sheets such as A3 sheets are delivered and stacked on two stacking trays to extend across them.

In such a case, as a result of delivering given sheets, it may become impossible to stack large sheets delivered upon execution of the next job. Assume, for example, that small sheets, that is, B5 sheets are to be delivered when small sheets, that is, A4 sheets have already been stacked on stacker tray B-1 of stacker B, as shown in FIG. 13. In this case, if the user designates stacker tray A-1 as the delivery destination of the B5 sheets, one stacking tray of each of adjacent stackers A and B is used, so large sheets to be delivered upon execution of the next job cannot be stacked on appropriate stacking trays. In this manner, even if a stacking unit on which no sheets are stacked is present, large sheets printed in the next job cannot be delivered to appropriate stacking trays.

SUMMARY OF THE INVENTION

An aspect of the present invention is to eliminate the above-mentioned problems with the conventional technology.

The present invention provides a technique of efficiently stacking large and small sheets using a plurality of stacking units.

The present invention in its first aspect provides a sheet processing apparatus which is able to control to stack a sheet on at least one of a plurality of stacking units, the apparatus comprising: a stacking control unit configured to control to stack a sheet, having a small size that can be stacked on one stacking unit, on one of the plurality of stacking units, and to stack a sheet, having a large size that cannot be stacked on one stacking unit, on a plurality of adjacent stacking units so that the sheet having the large size extends across the plurality of adjacent stacking units; a determination unit configured to, when a first sheet having the small size is stacked on a first stacking unit, and a second sheet having the small size is designated to be stacked on a second stacking unit different from the first stacking unit, determine whether or not a sheet is stacked on a stacking unit adjacent to the second stacking unit; and a control unit configured to select a third stacking unit, that is different from the second stacking unit and is adjacent to a stacking unit on which a sheet is stacked, as a stacking unit for the second sheet if the determination unit determines that no sheet is stacked on the stacking unit adjacent to the second stacking unit.

The present invention in its second aspect provides a method of controlling a sheet processing apparatus which is able to control to stack a sheet on at least one of a plurality of stacking units, the method comprising: a stacking control step of controlling to stack a sheet, having a small size that can be stacked on one stacking unit, on one of the plurality of stacking units, and to stack a sheet, having a large size that cannot be stacked on one stacking unit, on a plurality of adjacent stacking units so that the sheet having the large size extends across the plurality of adjacent stacking units; a determination step of, when a first sheet having the small size is stacked on a first stacking unit, and a second sheet having the small size is designated to be stacked on a second stacking unit different from the first stacking unit, determining whether or not a sheet is stacked on a stacking unit adjacent to the second stacking unit; and a control step of selecting a third stacking unit, that is different from the second stacking unit and is adjacent to a stacking unit on which a sheet is stacked, as a stacking unit for the second sheet if it is determined that no sheet is stacked on the stacking unit adjacent to the second stacking unit.

The present invention in its third aspect provides a computer-readable storage medium storing a program for causing a computer to execute: a stacking control step of controlling to stack a sheet, having a small size that can be stacked on one stacking unit among a plurality of stacking units which stack printed sheets, on one of the plurality of stacking units, and to stack a sheet, having a large size that cannot be stacked on one stacking unit, on a plurality of adjacent stacking units so that the sheet having the large size extends across the plurality of adjacent stacking units; a determination step of, when a first sheet having the small size is stacked on a first stacking unit, and a second sheet having the small size is designated to be stacked on a second stacking unit different from the first stacking unit, determining whether or not a sheet is stacked on a stacking unit adjacent to the second stacking unit; and a control step of selecting a third stacking unit, that is different from the second stacking unit and is adjacent to a stacking unit on which a sheet is stacked, as a stacking unit for the second sheet if it is determined that no sheet is stacked on the stacking unit adjacent to the second stacking unit.

According to the present invention, it is possible to efficiently stack large and small sheets using a plurality of stacking units.

Further features of the present invention will become apparent from the following description of exemplary embodiments with reference to the attached drawings.

BRIEF DESCRIPTION OF THE DRAWINGS

FIGS. 11A to 11D are tables for explaining stacking state management tables according to the embodiment;

FIG. 12 is a table illustrating an example of a table which defines two sheet sizes: large and small sizes.

DESCRIPTION OF THE EMBODIMENTS

Figure 1:
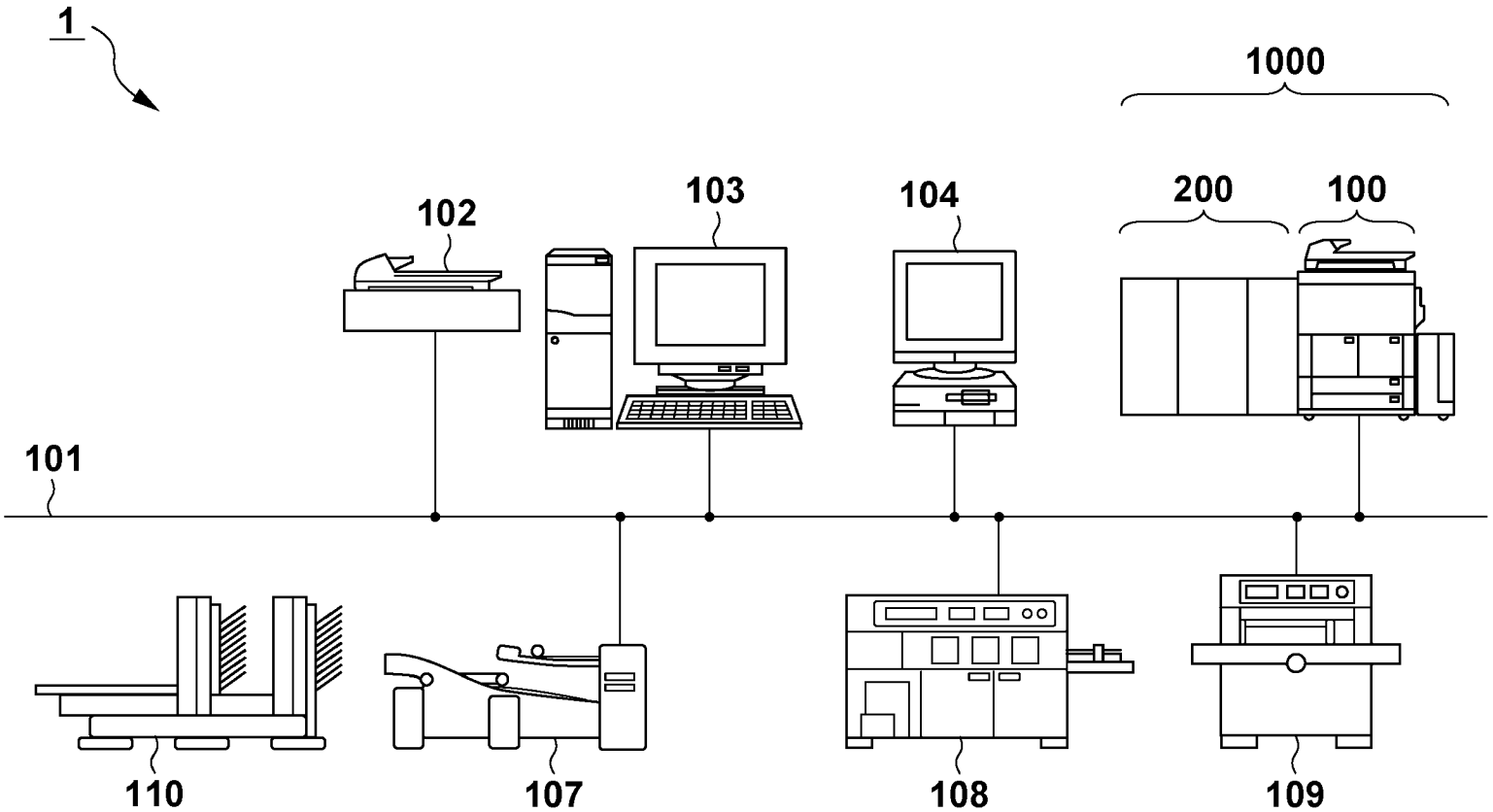
FIG. 1 is a view showing the configuration of a POD system according to an embodiment of the present invention.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. The same reference numerals denote the same constituent components, and a description thereof will not be given.

FIG. 1 is a view showing the configuration of a POD system 1 including a print system which exemplifies a sheet processing apparatus according to an embodiment of the present invention.

The POD system 1 includes a print system 1000, server computer 103, and client computer (PC) 104. The POD system 1 also includes a scanner 102, folding machine 107, case binding machine 108, cutting machine 109, and saddle stitching machine 110. The apparatuses other than the saddle stitching machine 110 are connected to each other via a network 101.

The print system 1000 includes a print apparatus 100 and sheet processing apparatus 200. The print apparatus 100 receives print data from the PC 104, prints on sheets based on the received data (PC print function), and transfers the printed sheets to the sheet processing apparatus 200 as needed to have it process the sheets. Although the print apparatus 100 is assumed to be a multifunction peripheral (MFP) having a plurality of functions such as a copy function and PC print function, it may be a print apparatus having only a PC print function.

The folding machine 107, case binding machine 108, cutting machine 109, and saddle stitching machine 110 are apparatuses which perform post-processing of printed sheets, like the sheet processing apparatus 200 of the print system 1000. The user removes sheets printed by the print apparatus 100 from a delivery (discharging) unit of the print system 1000, and sets the removed sheets in these sheet processing apparatuses to have them process the sheets. For example, the user uses the folding machine 107 to perform folding processing of the printed sheets. Also, the user uses the case binding machine 108 to perform case binding processing of the printed sheets. Moreover, the user uses the cutting machine 109 to perform cutting processing of the printed sheets. Again, the user uses the saddle stitching machine 110 to perform saddle stitching processing of the printed sheets.

The configuration of the print system 1000 will be described next with reference to FIG. 2.

Figure 2:
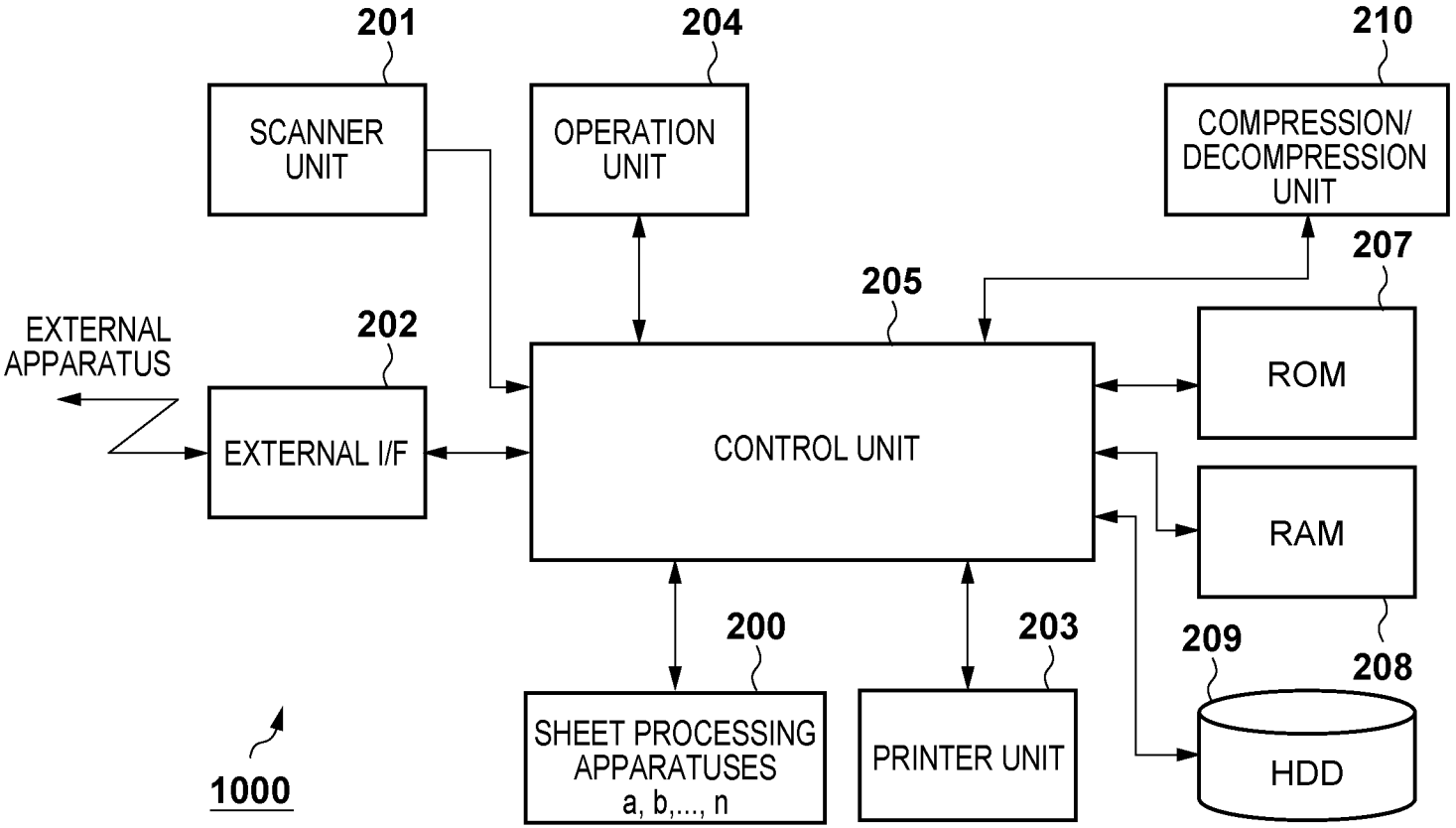
FIG. 2 is a block diagram showing the configuration of a print system.

FIG. 2 is a block diagram showing the configuration of the print system 1000.

The print system 1000 includes a scanner unit 201, external I/F unit 202, printer unit 203, operation unit 204, control unit 205, ROM 207, RAM 208, and HDD 209. These units are connected to each other via buses in the print system 1000.

The control unit 205 reads out and executes a program stored in the ROM 207 to systematically control the print system 1000. The scanner unit 201 reads a document, generates image data of the read document, and sends the generated image data to the control unit 205. The external I/F unit 202 controls data exchange with the external network 101. For example, the external I/F unit 202 receives image data sent from an external apparatus such as the PC 104, and sends it to the control unit 205. Also, the external I/F unit 202 sends data received from the control unit 205 to an external apparatus such as the PC 104 via the network 101. The printer unit 203 prints the image data received from the control unit 205 on sheets based on print settings (pieces of information concerning, for example, the print layout and the number of copies).

The operation unit 204 includes, for example, a display unit, touch panel, and hard keys, displays an operation screen on the display unit, and accepts instructions from the user from the touch panel provided on the display unit. The operation unit 204 also accepts instructions from the user via the hard keys, and notifies the control unit 205 of the accepted instructions. The ROM 207 stores a program to be executed by the control unit 205. The RAM 208 functions as a work memory of the control unit 205, and temporarily stores the program or image data read out from the ROM 207.

The HDD 209 is a nonvolatile storage medium, which stores both data of each job to be executed and the order of execution of jobs. When, for example, a copy job is to be executed, the control unit 205 associates image data read by the scanner unit 201 with print settings accepted via the operation unit 204, stores the associated data in the HDD 209 as a job, and executes the stored job. The control unit 205 executes the job stored in the HDD 209, and uses the printer unit 203 to print the image data stored in the HDD 209, based on the print settings stored in association with this image data. However, when a print job is to be executed, the control unit 205 associates image data accepted via the external I/F unit 202 with print settings, stores the associated data in the HDD 209 as a job, and executes the stored job. The control unit 205 executes the job stored in the HDD 209 in association with the image data. The HDD 209 can store a plurality of jobs, and the control unit 205 executes the plurality of stored jobs in the order they were accepted. Note that the order of execution of the jobs can be changed by the user. Also, the order of execution of the jobs is changed by the control unit 205 when a predetermined condition is satisfied.

A compression/decompression unit 210 compresses or decompresses, for example, image data stored in the RAM 208 or HDD 209, using various compression formats such as JBIG or JPEG. The sheet processing apparatus 200 is connected to the print apparatus 100, and performs various types of sheet processing such as sheet stacking processing, case binding processing, and saddle stitching processing for sheets printed by the print apparatus 100.

The configuration of the print system 1000 will be described next with reference to FIG. 3.

Figure 3:
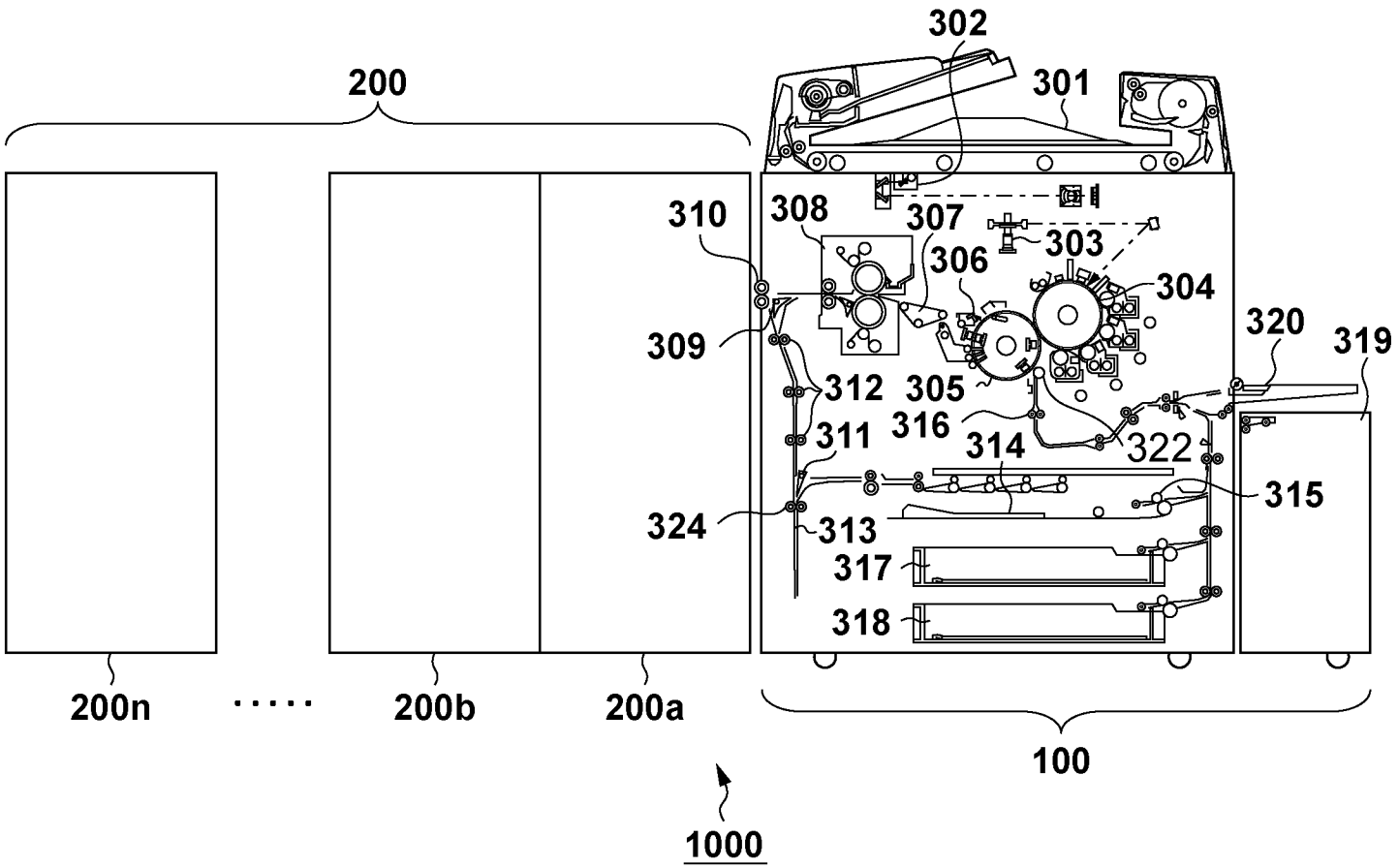
FIG. 3 is a sectional view of the print system according to the embodiment.

FIG. 3 is a sectional view of the print system 1000 according to this embodiment.

Although the print apparatus 100 is assumed to be a 1D (single-drum) type color multifunction peripheral in this embodiment, the configuration of the print apparatus 100 is not limited to this, and a monochrome multifunction peripheral or a 4D (four-drum) type color multifunction peripheral may be employed. Note that a multifunction peripheral is also called a multifunction processing apparatus (MFP).

An automatic document feeder (ADF) 301 separates the pages of a document set in a document tray in turn from the first page, and feeds it onto a document glass platen. A reading unit 302 reads an image of each page of the document fed onto the document glass platen, and converts it into image data using a CCD. A rotating multifaceted mirror (for example, a rotating polygon mirror) 303 receives a light beam such as laser light modulated in accordance with the image data, reflects the light beam via a reflecting mirror, and irradiates a photosensitive drum 304 with the light beam as scanning light. A latent image formed on the photosensitive drum 304 by the laser light is developed by toner.

Also, the print apparatus 100 conveys, to registration rollers 316, a sheet fed from one of paper feed cassettes 317 to 320 which exemplify a paper feed unit, attaches it onto a transfer drum 305, and transfers a toner image on the photosensitive drum 304 onto the attached sheet.

This series of image forming processes is sequentially executed using toners of yellow (Y), magenta (M), cyan (C), and black (K) to form a full-color image. After this series of image forming processes is repeated four times, the sheet on the transfer drum 305 having the full-color image formed on it is separated by a separation gripper 306 and conveyed to a fixing device 308 via a pre-fixing conveyance device 307. The fixing device 308 is formed using rollers and a belt in combination, includes an internal heat source such as a halogen heater, and melts, by heat and pressure, the toner on the sheet having the toner image formed on it to fix this toner on this sheet. A delivery flapper 309 can swing about a swing axis as a center to regulate the direction in which the sheet is conveyed. While the delivery flapper 309 swings clockwise in FIG. 3, the sheet is conveyed straight to a large-volume stacker 200*a* by delivery rollers 310. In this case, large-volume stackers 200*a* to 200*n* are provided.

On the other hand, in forming images on the two surfaces of the sheet, the delivery flapper 309 swings counterclockwise in FIG. 3 to change the direction in which the sheet is conveyed to the downward direction and feed it to a double-sided conveyance unit. The double-sided conveyance unit includes a reversal flapper 311, reversal rollers 312, a reversal guide 313, and a double-sided tray 314. The reversal flapper 311 swings about a swing axis as a center to regulate the direction in which the sheet is conveyed. When a double-sided print job is to be processed, the scanner unit 201 controls the reversal flapper 311 to swing counterclockwise in FIG. 3 so as to feed a sheet having an image printed on its first surface to the reversal guide 313 via the reversal rollers 312. While the trailing edge of the sheet is clamped by reversal rollers 324, the reversal rollers 324 are temporarily stopped, and then the reversal flapper 311 is swung clockwise in FIG. 3 to rotate the reversal rollers 324 in the opposite direction. Upon this operation, the scanner unit 201 controls to guide the sheet to the double-sided tray 314 after the sheet is switched back and conveyed and its leading and trailing edges are interchanged. The sheet is temporarily held on the double-sided tray 314, and fed to the registration rollers 316 again by paper refeed rollers 315. At this time, the sheet is fed while its second surface opposite to its first surface on which toner is transferred in the first surface transfer process is opposed to the photosensitive drum 304. In the same way as in the above-mentioned first surface transfer process, an image is formed on the second surface of the sheet. After images are formed on the two surfaces of the sheet and fixed by the fixing device 308, the sheet is conveyed to downstream apparatuses by the delivery rollers 310.

Sheets of a job set to stack the sheets on a large-volume stacker among the downstream apparatuses are conveyed to the large-volume stacker. Sheets of a job set to bind the sheets by a sizing machine are conveyed to the sizing machine. Sheets of a job set to saddle-stitch the sheets are conveyed to the saddle stitching machine.

After the sheets are processed by each sheet processing apparatus, they are delivered to the delivery unit of this sheet processing apparatus.

Figure 4:
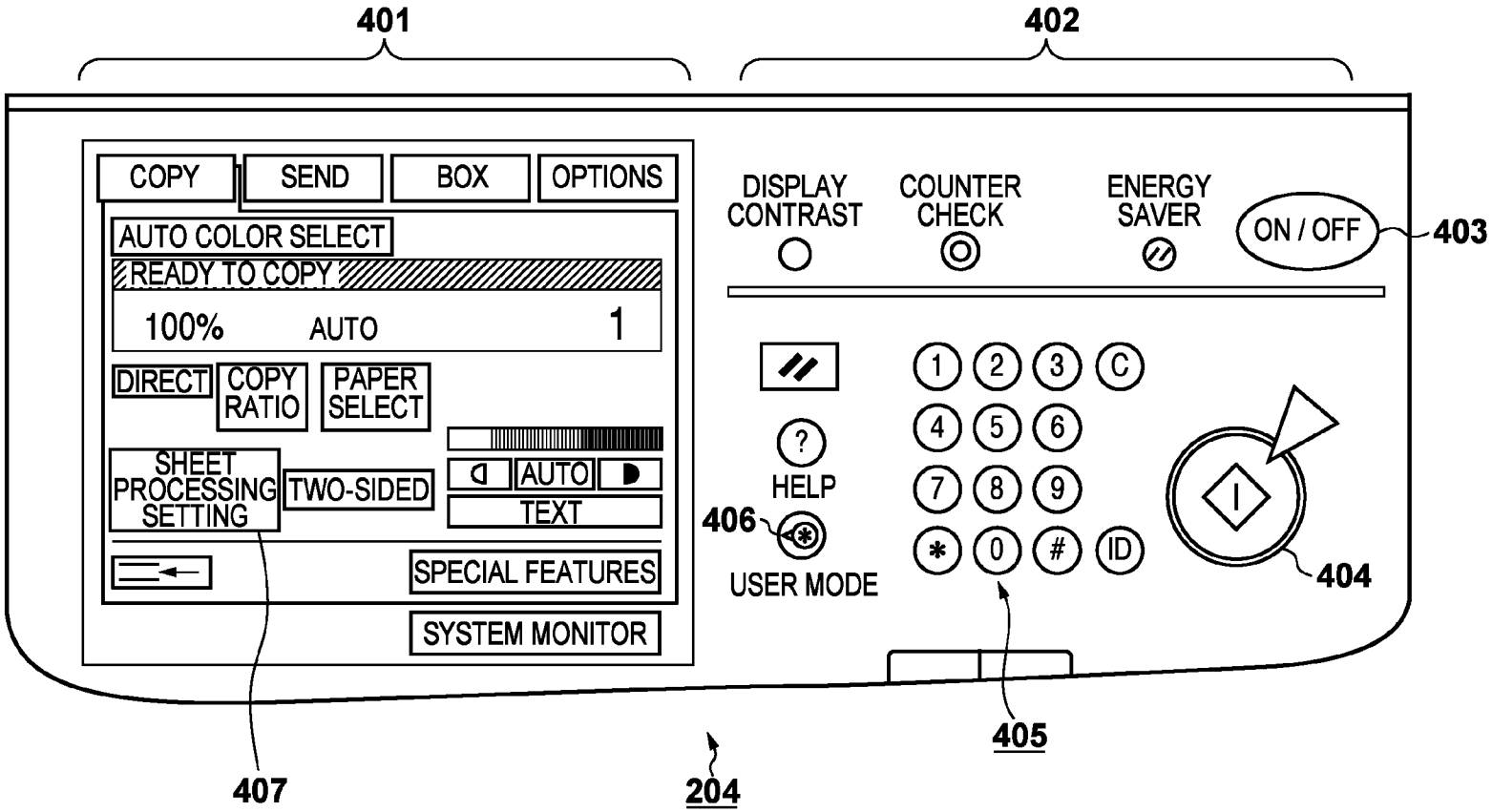
FIG. 4 is a top view showing the configuration of an operation unit.

FIG. 4 is a top view showing the configuration of the operation unit 204.

The operation unit 204 includes a touch panel unit 401 including soft keys, and a key input unit 402 including hard keys. The touch panel unit 401 includes a liquid crystal display unit and a touch panel attached on it. The touch panel unit 401 accepts instructions from the user, and displays various messages, thereby notifying the user of given information. When the user presses a "Copy" tab of the touch panel unit 401, an operation screen for a copy function is displayed on the touch panel unit 401. Also, when the user presses a "Send" tab, an operation screen for a data sending function such as fax and e-mail sending is displayed on the touch panel unit 401. When the user presses a "Box" tab, an operation screen for a box function is displayed on the touch panel unit 401. The box function means a function of storing image data read by the scanner unit 201 in the HDD 209, and selecting print data stored in the HDD 209 at a desired timing, thereby printing the selected print data using the printer unit 203.

A power supply switch 403 is a button for switching the print system 1000 between a standby mode (normal operation state) and a sleep mode (the state in which the print system 1000 keeps power consumption low upon the stop of the program while standing by for an interruption such as network printing or facsimile sending). A "Start" key 404 serves to instruct the start of a copy or sending operation. A numeric keypad 405 serves to, for example, set the number of copies or input a password. A "User Mode" key 406 serves to perform various settings of the print system 1000. A "Sheet Processing Setting" key 407 serves to set sheet processing performed by the sheet processing apparatus 200. When the user presses the "Sheet Processing Setting" key 407, the control unit 205 displays a screen shown in FIG. 5 on the touch panel unit 401.

Figure 5:
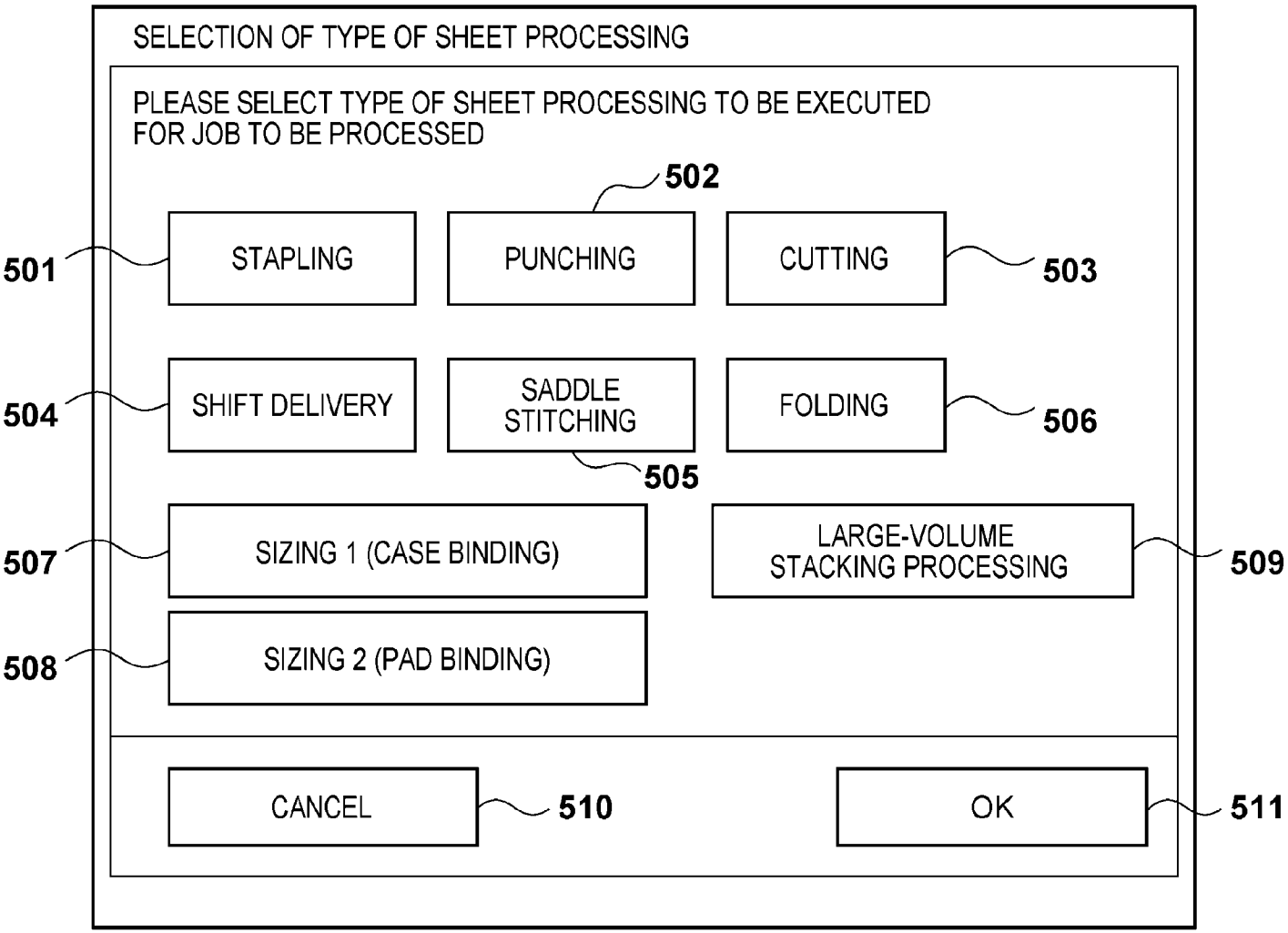
FIG. 5 is a view illustrating an example of an operation screen for sheet processing setting.

FIG. 5 is a view illustrating an example of an operation screen for sheet processing setting.

Buttons for accepting setting of the type of sheet processing that can be executed by the print system 1000. The type of executable sheet processing is changed in accordance with the configuration of the print system 1000.

The operation screen shown in FIG. 5 includes keys for executing the following types of processing:

(1) Stapling Processing (Key 501)
(2) Punching Processing (Key 502)
(3) Cutting Processing (Key 503)
(4) Shift Delivery Processing (Key 504)
(5) Saddle Stitching Processing (Key 505)
(6) Folding Processing (Key 506)
(7) Case Binding Processing (Key 507)
(8) Pad Binding Processing (Key 508)
(9) Large-volume Stacking Processing (Key 509)

The control unit 205 controls to execute, for the sheets printed by the print apparatus 100, sheet processing selected from the above-mentioned types of sheet processing (1) to (9) via the screen shown in FIG. 5.

When, for example, the user presses an "OK" key 511 while the key 505 (saddle stitching) is selected in the copy function, and presses the "Start" key 404, the control unit 205 reads a document using the scanner unit 201. The control unit 205 prints image data of the read document on sheets in accordance with print settings accepted via the operation unit 204. The control unit 205 conveys the printed sheets to the saddle stitching machine shown in FIG. 3 to execute saddle stitching processing.

However, when the user presses the "OK" key 511 while the key 509 (large-volume stacking processing) is selected, and presses the "Start" key 404, the control unit 205 reads a document using the scanner unit 201. The control unit 205 prints image data of the read document on sheets in accordance with print settings accepted via the operation unit 204. The control unit 205 conveys the printed sheets to the large-volume stacker shown in FIG. 3 to execute large-volume stacking processing. Note that a "Cancel" key 510 serves to cancel selection of the type of sheet processing.

Figure 6:
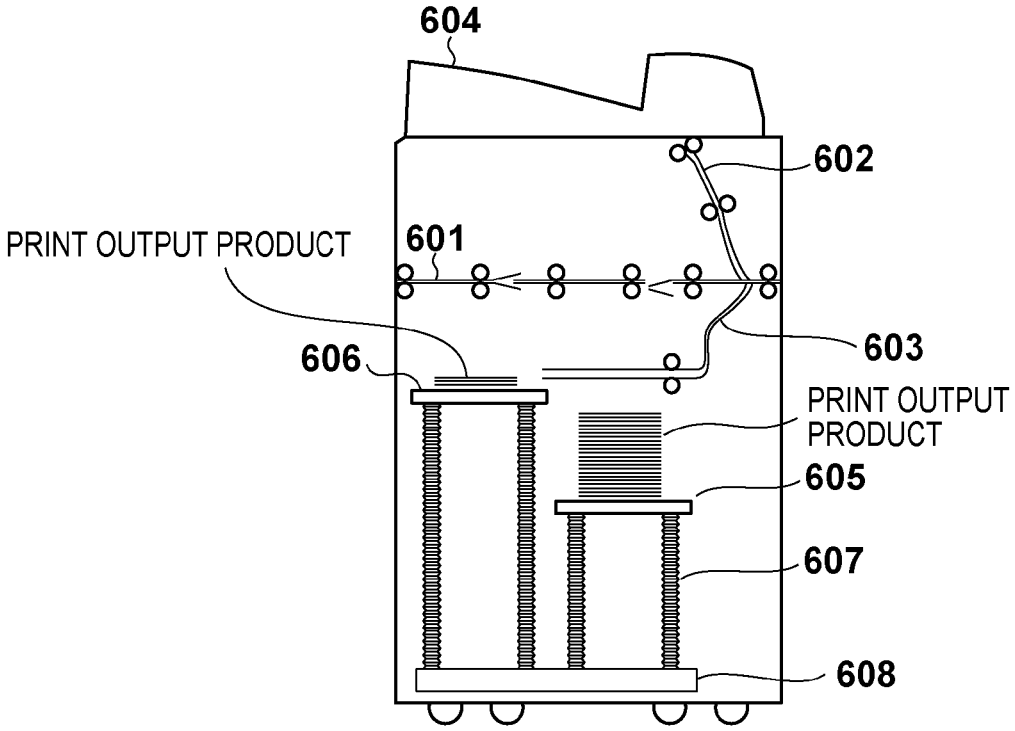
FIG. 6 is a sectional view showing the configuration of a large-volume stacker according to the embodiment.
Figure 7:
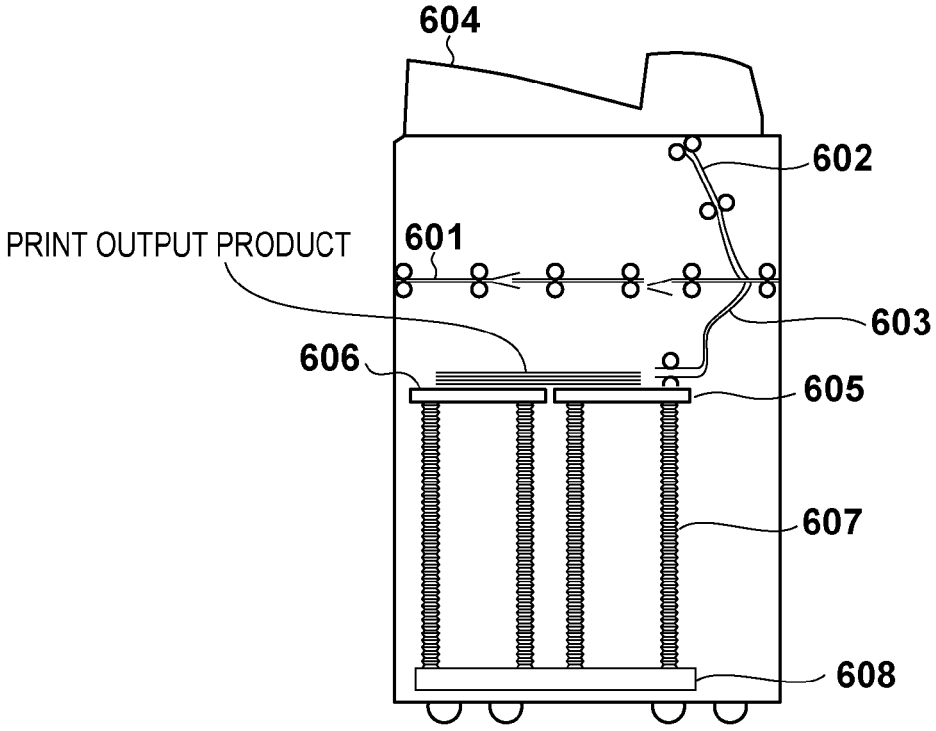
FIG. 7 is a sectional view showing the configuration of another large-volume stacker according to the embodiment.

FIGS. 6 and 7 are sectional views showing the configurations of large-volume stackers according to this embodiment. Note that the shape of a sheet conveyance path is not limited to that shown in FIG. 6, and the sheet conveyance path may have the shape of the large-volume stacker shown in FIG. 3.

The large-volume stacker includes a straight path 601, escape path 602, and stack path 603. The straight path 601 is a sheet conveyance path along which printed sheets conveyed from an upstream apparatus (the print apparatus 100 in this embodiment) is conveyed to a downstream apparatus (the case binding apparatus in this embodiment). Sheets printed by executing a job which does not designate to stack the sheets on the large-volume stacker are conveyed to the downstream apparatus via the straight path 601. The escape path 602 is a sheet conveyance path along which sheets are conveyed to an escape tray 604. The stack path 603 is a sheet conveyance path along which sheets printed by executing a job that designates to stack the sheets on the large-volume stacker are conveyed to a stacker tray.

The large-volume stacker includes stacker trays (stacking trays) 605 and 606 which stack sheets. Each stacker tray is mounted on a carriage 608 by expandable stays 607. The carriage 608 is used to allow the user to carry sheets stacked on each stacker tray to another sheet processing apparatus. When an instruction to open the front door of the carriage 608 is issued, each stacker tray descends so that the user can easily carry it on the carriage 608. However, as the carriage 608 is set in the large-volume stacker, each stacker ascends to a position shown in FIG. 6 or 7 so that sheets delivered from the stack path 603 can be easily stacked on it. Each stacker tray ascends so that the top surface of the sheets stacked on each stacker tray is set at the level of the stack path 603, as shown in FIG. 6 or 7. The flapper switches whether sheets delivered from the stack path 603 are to be stacked on the stacker tray 605 or 606. If sheets delivered from the stack path 603 are to be stacked on the stacker tray 605, they are guided and delivered to the stacker tray 605 along the lower conveyance path. However, if sheets delivered from the stack path 603 are to be stacked on the stacker tray 606, they are conveyed along the upper conveyance path and delivered to the stacker tray 606 by the flapper. When sheets delivered from the stack path 603 are to be stacked on the stacker tray 605, the control unit 205 controls an abutment plate to move to the position of the stacker tray 605 so that the sheets are stacked on the stacker tray 605 in an aligned state. However, when the sheets delivered from the stack path 603 are to be stacked on the stacker tray 606, the control unit 205 controls the abutment plate to move to the position of the stacker tray 606 so that the sheets are stacked on the stacker tray 606 in an aligned state.

Sheets delivered from the stack path 603 can also be delivered to the two stacker trays 605 and 606 to extend across them while these stacker trays are flush with each other, as shown in FIG. 7. In this case, the sheets are guided and delivered along the lower conveyance path by the flapper. The control unit 205 controls the abutment plate in accordance with the size of the sheets so that they are stacked on the stacker trays 605 and 606 in an aligned state. If, for example, the dimension of sheets to be delivered in the direction in which they are conveyed is larger than that of one stacker tray, the control unit 205 controls to stack the sheets on the two stacker trays to extend across them. When sheets delivered from the stack path 603 are to be stacked on the two stacker trays to extend across them, the leading edge of the first sheet may be guided onto the stacker tray 606 by a clamping unit provided on the abutment plate so as to prevent the sheets from entering the gap between the stacker trays 605 and 606. A sheet having a dimension in which it is conveyed, which is larger than that of one stacker tray, is defined as a large sheet. However, a sheet having a dimension in which it is conveyed, which is equal to or smaller than that of one stacker tray, is defined as a small sheet.

Figure 8:
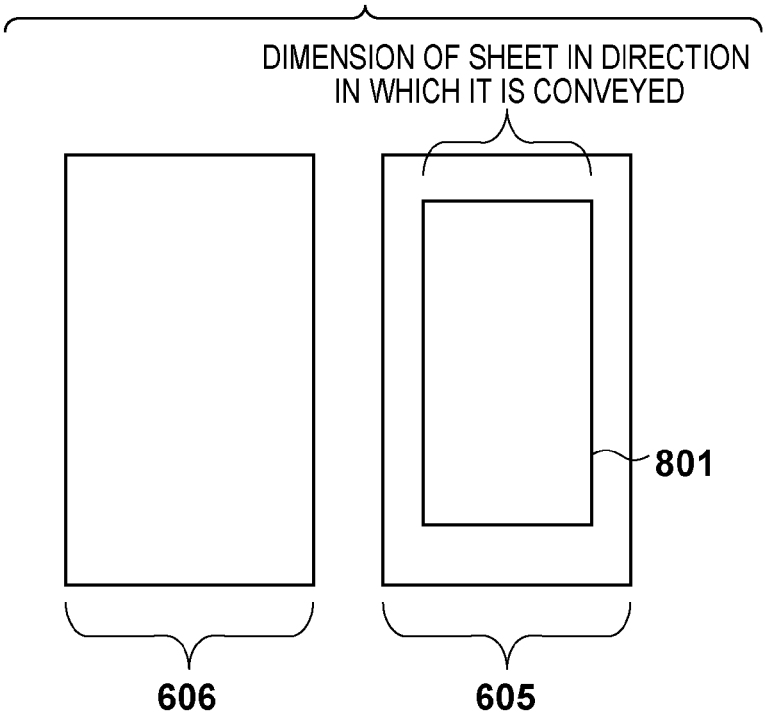
FIG. 8 is a view of stacker trays according to the embodiment when viewed from above.
Figure 9:
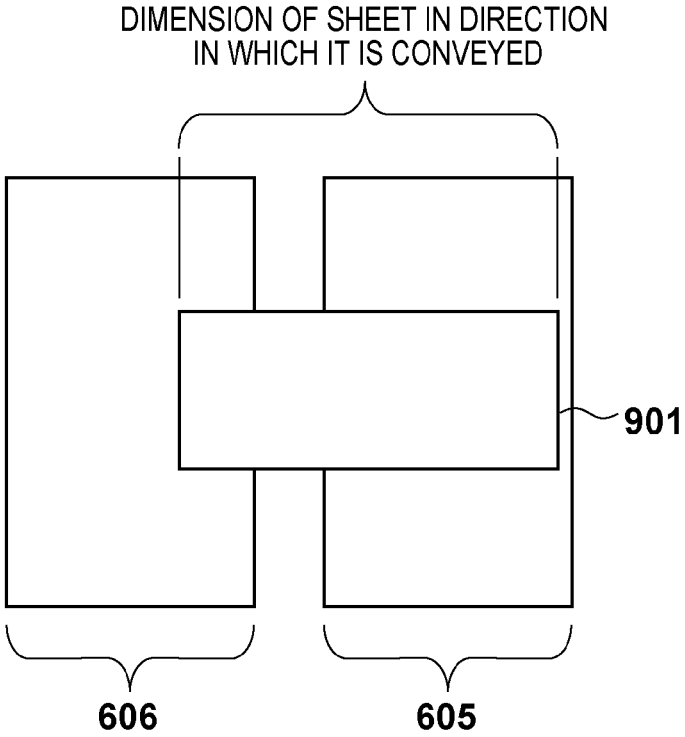
FIG. 9 is a view of stacker trays according to the embodiment when viewed from above.

FIGS. 8 and 9 are views of the stacker trays 605 and 606 when viewed from above.

Reference numeral 801 in FIG. 8 denotes a small sheet stacked on the stacker tray 605. The dimension of the sheet 801 in the direction in which it is conveyed is smaller than that of the stacker tray 605.

Reference numeral 901 in FIG. 9 denotes a large sheet stacked on the stacker trays 605 and 606. When the large sheet 901 is to be stacked, the control unit 205 controls that the sheet 901 is delivered to the two stacker trays 605 and 606 to extend across them, as shown in FIG. 9.

In this embodiment, the above-mentioned configuration is used to perform the following control.

Figure 10A:
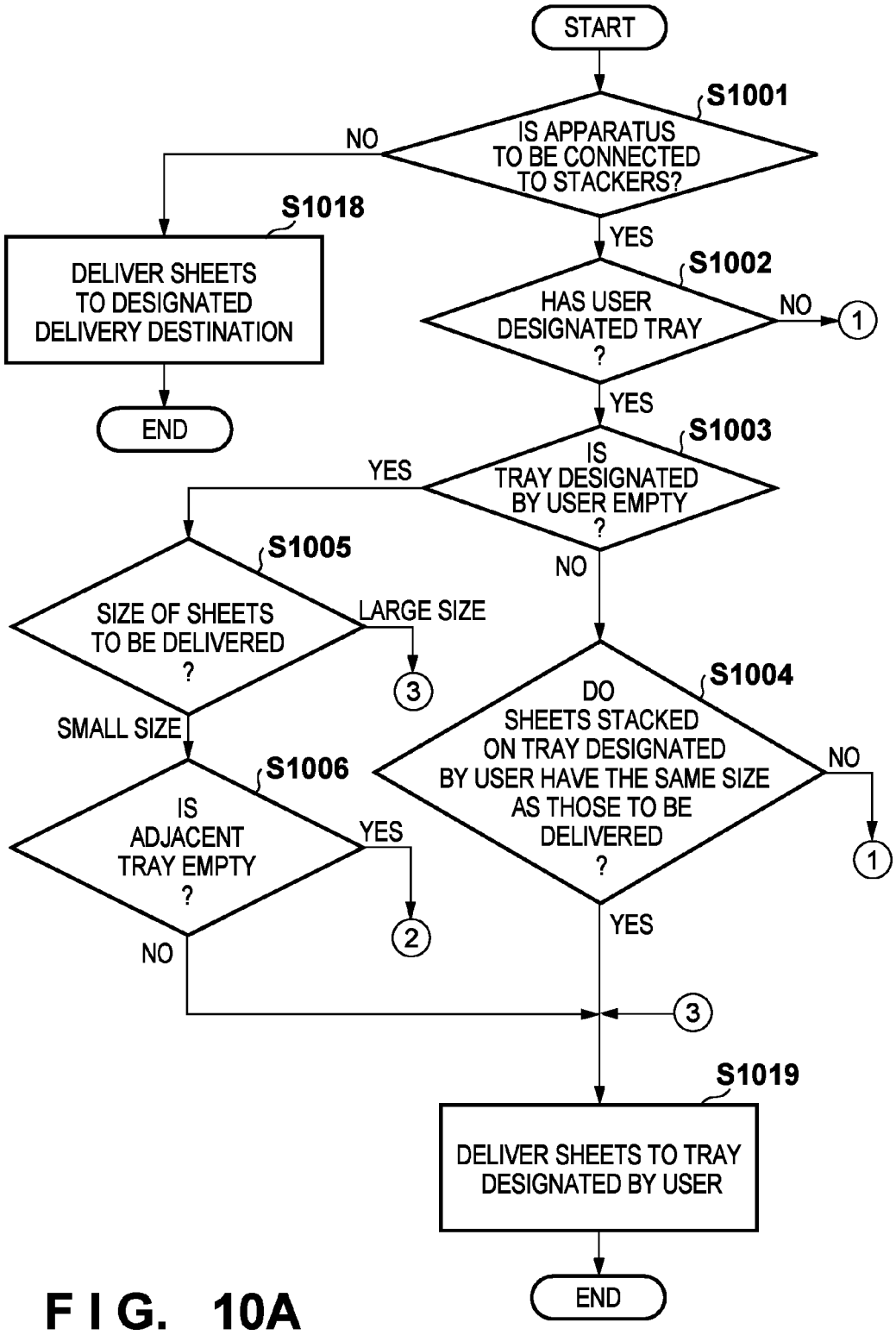
FIGS. 10A to 10C are flowcharts for explaining sheet stacking control processing performed by a control unit of the print system according to the embodiment.
Figure 10B:
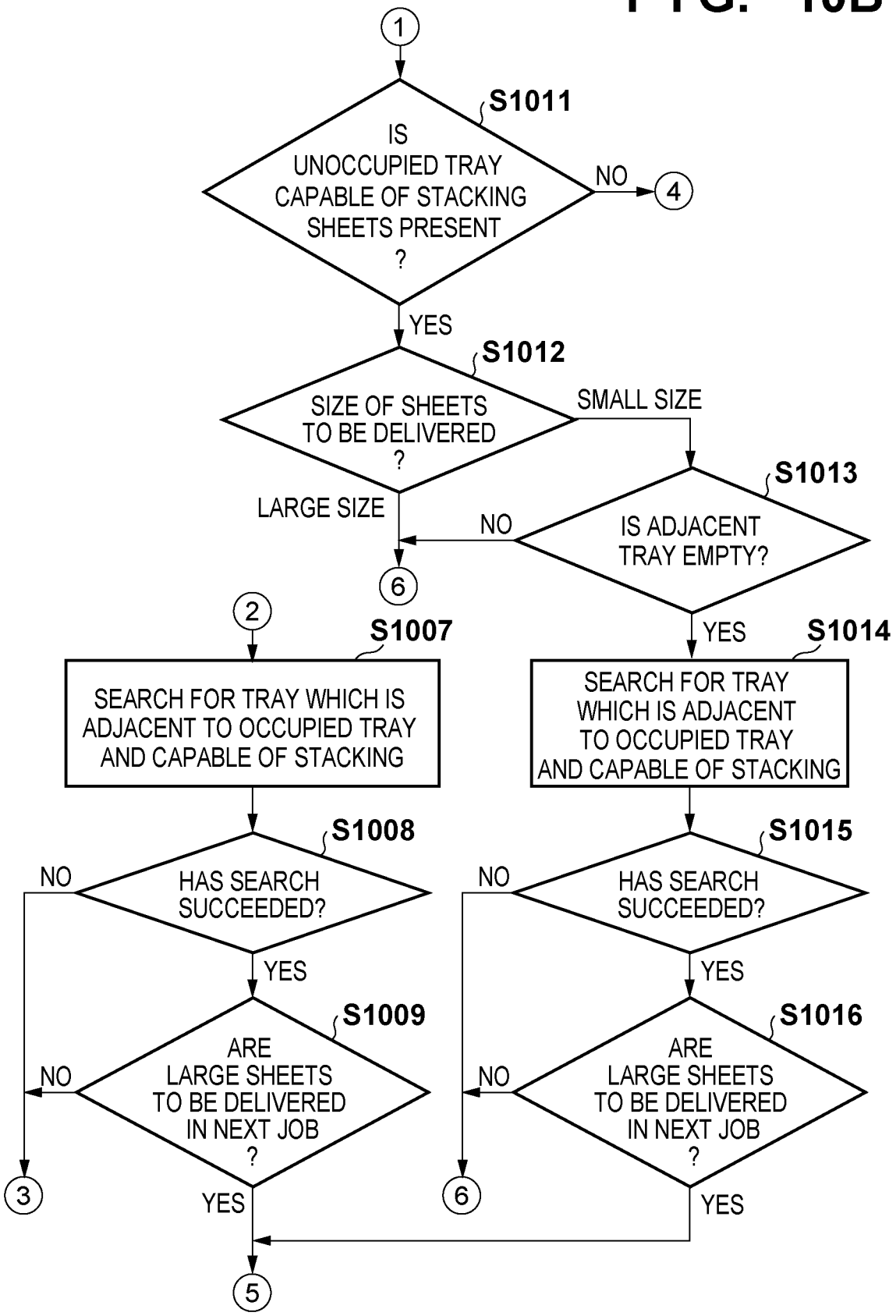
Figure 10C:
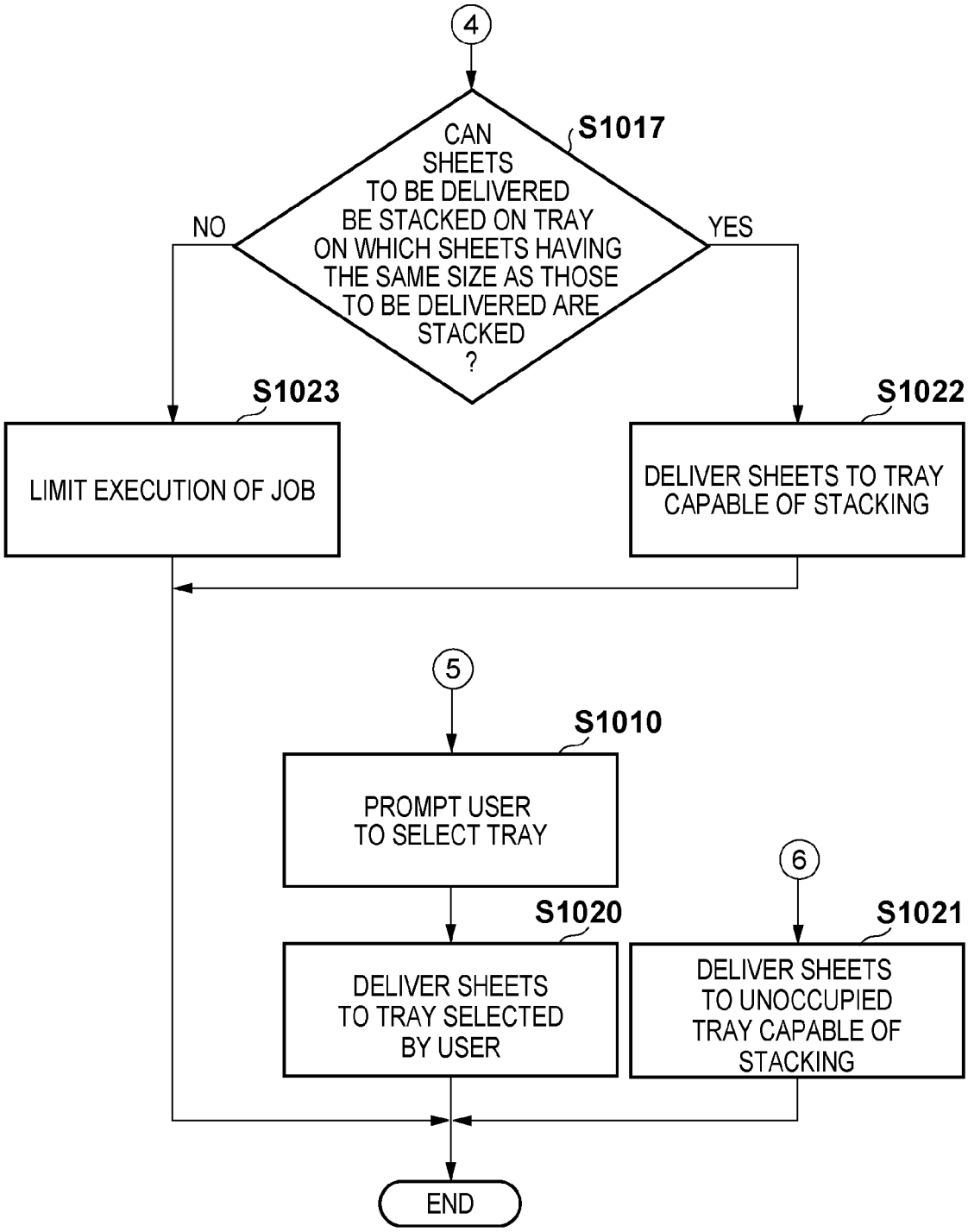

FIGS. 10A to 10C are flowcharts for explaining sheet stacking control processing executed by the control unit 205 of the print system 1000 according to this embodiment. The control unit 205 reads out and executes a program stored in the ROM 207 to perform a process in each step shown in this flowchart.

When the control unit 205 accepts an instruction to execute a job from the operation unit 204 in the copy function, it stores information of the accepted job in the RAM 208. The information of the accepted job includes settings (for example, pieces of information concerning the type of sheet processing and sheets used) accepted via the operation unit 204 shown in FIGS. 4 and 5. The information concerning sheets used is set to "Auto" in default, and is determined in correspondence with the size of a document after the document is read by the scanner unit 201. Also, among a plurality of sizes such as A4 and B5, a specific size may be designated via a "Paper Select" button displayed on the operation unit 204 shown in FIG. 4. When the control unit 205 accepts an instruction to execute a job, it performs processing in accordance with the flowchart shown in FIGS. 10A to 10C, based on information of the job stored in the RAM 208 and information of sheets stacked on each stacker tray. Note that the information of sheets stacked on each tray is stored in the RAM 208 as stacking state management tables, as shown in FIGS. 11A to 11D.

FIG. 11A shows the state in which no sheets are stacked on the stacker trays 605 and 606. Assume that the control unit 205 executes job 1 and delivers A4 sheets to the stacker tray 605. In this case, the control unit 205 changes the presence/absence of sheets on the stacker tray 605 from "Absence" to "Presence", and changes the size of stacked sheets from "–" to "A4". FIG. 11B shows a stacking state management table at this time.

Assume that the control unit 205 executes job 2 and delivers B5 sheets to the stacker tray 606. In this case, the control unit 205 changes the presence/absence of sheets on the stacker tray 606 from "Absence" to "Presence", and changes the size of stacked sheets from "–" to "B5". FIG. 11C shows a stacking state management table at this time.

The large-volume stacker according to this embodiment includes a sensor which detects the presence/absence of sheets stacked on the stacker trays 605 and 606. If this sensor detects the absence of sheets, the state of the stacking state management table is returned to that shown in FIG. 11A. When, for example, the user removes all sheets stacked on each stacker tray, no stacked sheets remain on the large-volume stacker. In this case, the control unit 205 resets the state of the stacking state management table to that shown in FIG. 11A, based on the information obtained by the sensor.

FIG. 11D shows the contents of the table updated by the control unit 205 when large sheets are delivered to the stacker trays 605 and 606 to extend across them.

Using such a stacking state table, the control unit 205 determines whether sheets stacked on the stacker trays 605 and 606 of the large-volume stacker are present.

The flowchart shown in FIGS. 10A to 10C will be described in detail below. First, in step S1001, the control unit 205 executes a job based on its information to determine whether sheets are to be delivered to the stacker tray of the large-volume stacker. When a job set to execute large-volume stacking processing is issued from the operation unit 204, the delivery destination of the job is the stacker tray of the large-volume stacker. Therefore, if the accepted job is set to execute large-volume stacking processing, the control unit 205 determines that sheets of the job are to be delivered to the stacker tray of the large-volume stacker, and advances the process to step S1002. On the other hand, if the control unit 205 determines that the accepted job is not set to execute large-volume stacking processing, it advances the process to step S1018. In step S1018, the control unit 205 controls that sheets are delivered to the delivery destination designated in the job. If the job is set to execute, for example, case binding, the control unit 205 conveys the sheets to the sizing machine to have it execute their case binding processing, and delivers them to the delivery unit of the case binding machine. However, if the job is set to execute saddle stitching, the control unit 205 conveys the sheets to the saddle stitching machine to have it execute their saddle stitching processing, and delivers them to the delivery unit of the saddle stitching machine.

When the sheets are to be delivered to the stacker tray of the large-volume stacker, the control unit 205 advances the process to step S1002, in which it determines whether the user has designated a tray. If YES is determined in step S1002, the control unit 205 advances the process to step S1003; otherwise, it advances the process to step S1011. In step S1003, the control unit 205 determines whether the tray designated by the user is empty. The control unit 205 performs this determination using stacking state management tables as shown in, for example, FIGS. 11A to 11D. If YES is determined in step S1003, the control unit 205 advances the process to step S1005; otherwise, it advances the process to step S1004. In step S1004, the control unit 205 determines whether sheets stacked on the tray designated by the user has the same size as those to be delivered. The control unit 205 performs this determination using stacking state management tables as shown in, for example, FIGS. 11A to 11D. If YES is determined in step S1004, the control unit 205 advances the process to step S1019, in which it delivers the sheets to the tray designated by the user. On the other hand, if NO is determined in step S1004, the control unit 205 advances the process to step S1011.

If YES is determined in step S1003, the control unit 205 advances the process to step S1005. In step S1005, the control unit 205 looks up a table, as shown in FIG. 12, in the RAM 208 to determine whether the sheets of the accepted job have a large or small size.

FIG. 12 is a table illustrating an example of a table which defines two sheet sizes: large and small sizes.

If the size of sheets of the accepted job is A4 or B5, the control unit 205 determines based on the table shown in FIG. 12 that these sheets have a small size. However, if the size of sheets of the accepted job is A3 or B4, the control unit 205 determines based on the table shown in FIG. 12 that these sheets have a large size. Note that FIG. 12 merely provides an example of the sheet sizes, and a large or small size may be defined for other sizes such as the letter size and legal size. Also, if the sheets have A4 size but are set in the paper feed unit so that they are conveyed in its longitudinal direction, that is, if the sheets are set in A4 landscape mode, the A4 landscape sheets may be defined to have a large size.

In this manner, if the control unit 205 determines in step S1005 that the sheets of the job have a large size, it advances the process to step S1019, in which it controls that the sheets delivered upon execution of the job are stacked on the tray designated by the user. On the other hand, if the control unit 205 determines in step S1005 that the sheets of the job have a small size, it advances the process to step S1006, in which it determines whether a tray adjacent to that designated by the user is empty. If YES is determined in step S1006, the control unit 205 advances the process to step S1007; otherwise, it advances the process to step S1019. This is done to leave two or more adjacent trays empty as much as possible so as to ensure a space in which large sheets are to be stacked. In step S1007, the control unit 205 searches for a tray which is adjacent to an occupied tray and capable of stacking, and advances the process to step S1008. In step S1008, the control unit 205 determines whether the search has succeeded. If YES is determined in step S1008, the control unit 205 advances the process to step S1009; otherwise, it advances the process to step S1019.

Figure 13:
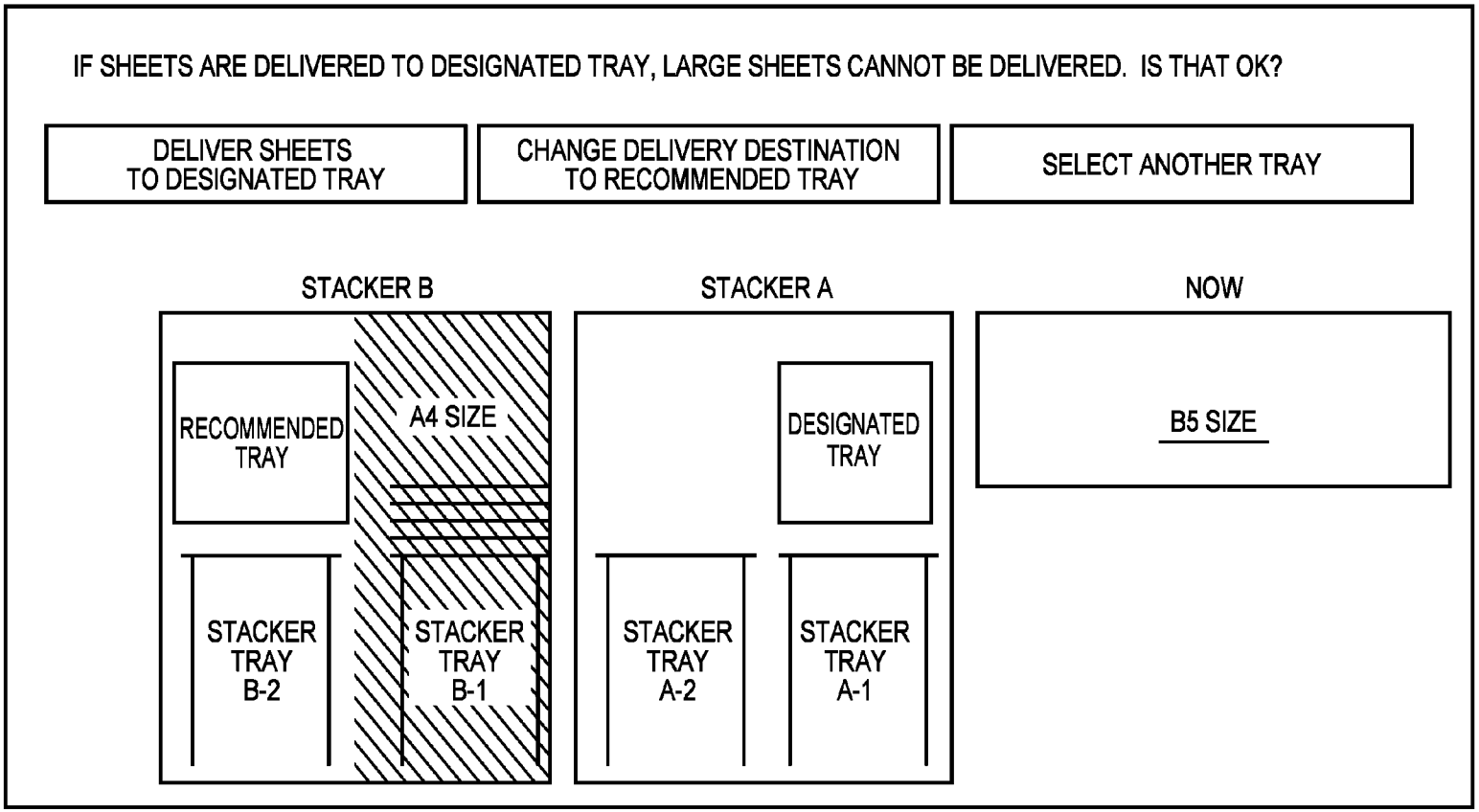
FIG. 13 is a view illustrating an example of a dialog box displayed on an operation screen when large sheets in the next job cannot be delivered and stacked on appropriate stacker trays if sheets are delivered to a designated tray.

In an example illustrated in FIG. 13, while A4 sheets are stacked on stacker tray B-1 of stacker B, the user instructs to deliver the sheets to stacker tray A-1 of stacker A. In this case, if the sheets are delivered to designated stacker tray A-1, two adjacent stackers are occupied, so large sheets printed in the next job cannot be delivered. Hence, a tray which is adjacent to an occupied tray and capable of stacking is searched for, thereby finding stacker tray B-2 as an appropriate stacker.

In step S1009, the control unit 205 determines whether large sheets are to be delivered in the next job. If YES is determined in step S1009, the control unit 205 advances the process to step S1010; otherwise, it advances the process to step S1019. In step S1010, the control unit 205 prompts the user to select a tray. The control unit 205 displays a screen, as shown in, for example, FIG. 13, on the operation unit to prompt the user to select stacker tray B-2. The control unit 205 then advances the process to step S1020, in which it delivers the sheets to the tray selected by the user.

FIG. 13 is a view illustrating an example of a dialog box displayed on the operation screen when small, first sheets are stacked on stacker tray B-1 (first stacking unit), so large sheets cannot be stacked if small, second sheets are delivered to a designated tray (second stacking unit; stacker tray A-1). FIG. 13 is a view illustrating an example of a dialog box displayed on the operation screen in that case. That is, if the second sheets are delivered to stacker tray A-1 designated by the user, and then the user instructs to deliver large sheets, the large sheets cannot be delivered to stacker trays A-1 and A-2 to extend across them. Hence, such an operation screen is displayed to confirm whether the user wants to change the delivery destination, and to present stacker tray B-2 (third stacking unit) as a recommended stacker tray.

On the other hand, if the control unit 205 determines in step S1002 that the sheets are to be delivered to the stacker tray of the large-volume stacker but the user has not designated a tray, it advances the process to step S1011, in which it determines whether an unoccupied tray capable of stacking sheets is present. The control unit 205 performs this determination using stacking state management tables as shown in, for example, FIGS. 11A to 11D. If YES is determined in step S1011, the control unit 205 advances the process to step S1012; otherwise, it advances the process to step S1017. In step S1012, the control unit 205 determines whether the sheets to be delivered have a large or small size. If the control unit 205 determines in step S1012 that the sheets to be delivered have a small size, it advances the process to step S1013; otherwise, it advances the process to step S1021, in which it delivers the sheets to the unoccupied tray capable of stacking.

If the control unit 205 determines in step S1012 that the sheets to be delivered have a small size, it advances the process to step S1013, in which it determines whether a tray adjacent to the tray found in step S1011 is empty, as in step S1006. If YES is determined in step S1013, the control unit 205 advances the process to step S1014; otherwise, it advances the process to step S1021. As in step S1007, in step S1014, the control unit 205 searches for a tray which is adjacent to an occupied tray and capable of stacking, and advances the process to step S1015. In step S1015, the control unit 205 determines whether the search has succeeded. If YES is determined in step S1015, the control unit 205 advances the process to step S1016; otherwise, it advances the process to step S1021. In step S1016, the control unit 205 determines whether large sheets are to be delivered in the next job. If YES is determined in step S1016, the control unit 205 advances the process to step S1010, in which it performs processing as described earlier. On the other hand, if NO is determined in step S1016, the control unit 205 advances the process to step S1021.

If the control unit 205 determines in step S1011 that an unoccupied tray capable of stacking sheets is absent, it advances the process to step S1017, in which it determines whether the sheets to be delivered can be stacked on a tray on which sheets having the same size as those to be delivered are stacked. If YES is determined in step S1017, the control unit 205 advances the process to step S1022; otherwise, it advances the process to step S1023. In step S1022, the control unit 205 delivers the sheets to be delivered to the tray on which sheets having the same size as those to be delivered are stacked. In step S1023, the control unit 205 limits (stops) job execution because the delivery destination of the sheets is not found.

Although each large-volume stacker includes two stacker trays in the above-mentioned embodiment, it may include three or more stacker trays. In the latter case, the sheets can be delivered to each stacker tray by individually providing a sheet conveyance path from the stack path of the large-volume stacker to this stacker tray.

Also, although the print system 1000 includes two large-volume stackers in the above description, the present invention is also applicable to a print system including three or more large-volume stackers connected to each other.

In the above-mentioned embodiment, the user is prompted to designate a tray when large sheets are to be delivered in the next job. However, the user may be prompted to designate a tray using other determination criteria, as a matter of course. The user may be prompted to designate a tray when, for example, large sheets are stored on a sheet feed line or a job including large sheets is present in the history of a specific number of jobs.

Also, although the user is prompted to designate a tray in the above-mentioned embodiment, a control method in which the delivery tray is automatically changed and the user is notified to that effect after this change may be employed.

Moreover, although a job which uses the copy function is executed via the operation unit 204 in the above-mentioned embodiment, the same processing is also applicable when a job which uses the box function of printing image data stored in the HDD 209 is executed.

When a job which uses the box function is to be executed, the user selects image data stored in the HDD 209 via the operation unit 204, performs print settings, and issues a print instruction. In response to the print instruction, the control unit 205 executes the processing according to the flowchart shown in FIGS. 10A to 10C, based on the sheet settings and the type of sheet processing included in the print settings accepted via the operation unit 204.

The present invention is not limited to the copy and box functions, and is also applicable when the print system 1000 executes a job accepted from the PC 104 as an external apparatus. In this case, the user performs, for example, sheet settings and setting of the type of sheet processing via a printer driver on the PC 104 as an external apparatus, and sends the job to the print system 1000. Upon receiving the job from the PC 104 as an external apparatus, the control unit 205 of the print system 1000 performs the processing shown in the flowchart of FIGS. 10A to 10C, based on the settings of the received job.

In this embodiment, the processing shown in the flowchart of FIGS. 10A to 10C is started upon acceptance of a job execution instruction. However, this merely provides an example, and this processing may be started during sheet delivery.

The processing shown in the drawings of this embodiment may be executed by a host computer such as the PC 104 in accordance with an externally installed program. In this case, the PC 104 desirably displays each operation screen on the display of the PC 104 to accept an operation by the user via an operation means such as a mouse or keyboard provided in the PC 104.

Also, the stacker tray 605 as described above can be construed as the first or second stacking unit, and the stacker tray 606 can be construed as the first or second stacking unit as well. The control unit 205 performs stacking control to stack the sheets on these stacking units.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-106630, filed May 11, 2011, which is hereby incorporated by reference herein in its entirety.

What is claimed is:

1. A sheet processing apparatus comprising:

a stacking control unit configured to control stacking of a small sheet, which has a small size, on one of a plurality of stacking units, including a first stacking unit, a second stacking unit, a third stacking unit, and a fourth stacking unit, and stacking of a large sheet, which has a larger size than the small sheet, on the first stacking unit and the fourth stacking unit, which is adjacent to first stacking unit, or the second stacking unit and the third stacking unit, which is adjacent to the second stacking unit, among the plurality of stacking units, so that the large sheet is set across the first stacking unit and the fourth stacking unit, or the second stacking unit and the third stacking unit;

a determination unit configured to, in a case where a first sheet, which is a small sheet with the small size, is stacked on the first stacking unit, and a second sheet, which is also a small sheet with the small size, is designated to be stacked on the second stacking unit, determine whether or not any sheet is stacked on the third stacking unit, which is adjacent to the second stacking unit; and a control unit configured to select the fourth stacking unit, which is adjacent to the first stacking unit, for the second sheet, in a case where the determination unit determines that no sheet is stacked on the third stacking unit.

2. The apparatus according to claim 1, further comprising a notifying unit configured to notify a user that the control unit has selected the fourth stacking unit for the second sheet.

3. The apparatus according to claim 1, further comprising a query unit configured to inquire whether or not a user permits the control unit to select the fourth stacking unit for the second sheet.

4. The apparatus according to claim 1, wherein the control unit selects the fourth stacking unit for the second sheet in a case where a next job designates to stack a large sheet with the large size.

5. The apparatus according to claim 1, wherein the stacking control unit controls the second stacking unit to stack the second sheet, in a case where the determination unit determines that a sheet is stacked on the third stacking unit.

6. The apparatus according to claim 1, wherein the stacking control unit controls stacking of the second sheet on the designated second stacking unit, in a case where the determination unit determines that no sheet is stacked on the third stacking unit, and the fourth stacking unit is unavailable.

7. The system according to claim 1, wherein the discharging control unit discharges the second sheet on the designated second tray, in a case where the determination unit determines that the third sheet is not stacked on the third tray and the fourth tray is unavailable.

8. A method of controlling a sheet processing apparatus, the method comprising:

a stacking control step of controlling stacking of a small sheet, which has a small size, on one of a plurality of stacking units, including a first stacking unit, a second stacking unit, a third stacking unit, and a fourth stacking unit, and stacking of a large sheet, which has a larger size than the small sheet on the first stacking unit and the fourth stacking unit, which is adjacent to first stacking unit, or the second stacking unit and the third stacking unit, which is adjacent to the second stacking unit, among the plurality of stacking units, so that the large sheet is set across the first stacking unit and the fourth stacking unit, or the second stacking unit and the third stacking unit;

a determination step of, in a case where a first sheet, which is a small sheet with the small size, is stacked on the first stacking unit, and a second sheet, which is also a small sheet with the small size, is designated to be stacked on the second stacking unit, determining whether or not any sheet is stacked on the third stacking unit, which is adjacent to the second stacking unit; and a control step of selecting the fourth stacking unit, which is adjacent to the first stacking unit, for the second sheet in a case where the determination step determines that no sheet is stacked on the third stacking unit.

* * * * *